US009976380B2

(12) United States Patent
Davis et al.

(10) Patent No.: US 9,976,380 B2
(45) **Date of Patent: *May 22, 2018**

(54) GROOVED SWELLABLE PACKER

(71) Applicant: TAM INTERNATIONAL, INC., Houston, TX (US)

(72) Inventors: Tim Davis, Spring, TX (US); Andrew Kutac, Hallettsville, TX (US); Iain M. Greenan, Houston, TX (US); Ray Frisby, Houston, TX (US)

(73) Assignee: TAM INTERNATIONAL, INC., Houston, TX (US)

( * ) Notice: Subject to any disclaimer, the term of this patent is extended or adjusted under 35 U.S.C. 154(b) by 373 days.

This patent is subject to a terminal disclaimer.

(21) Appl. No.: 14/337,871

(22) Filed: Jul. 22, 2014

(65) Prior Publication Data

US 2015/0021044 A1 Jan. 22, 2015

Related U.S. Application Data

(60) Provisional application No. 61/857,086, filed on Jul. 22, 2013.

(51) Int. Cl.
*E21B 33/00* (2006.01)
*E21B 33/12* (2006.01)

(52) U.S. Cl.
CPC ..... *E21B 33/1208* (2013.01)

(58) Field of Classification Search
CPC .... E21B 33/1208; E21B 33/134; E21B 33/00; E21B 33/12; E21B 33/1277
See application file for complete search history.

(56) References Cited

U.S. PATENT DOCUMENTS

| | | | | |
|---|---|---|---|---|
| 2,420,226 | A | 5/1947 | Claus | |
| 3,385,367 | A | 5/1968 | Kollsman | |
| 4,871,179 | A | 10/1989 | Bell et al. | |
| 7,721,799 | B2 * | 5/2010 | Baski | E21B 34/10 166/101 |
| 7,762,322 | B2 * | 7/2010 | Andersen | E21B 17/023 166/118 |
| 7,819,200 | B2 | 10/2010 | Cornelissen | |
| 7,931,092 | B2 | 4/2011 | Olinger | |
| 8,083,000 | B2 | 12/2011 | Nutley et al. | |
| 8,087,459 | B2 | 1/2012 | Caldwell et al. | |

(Continued)

FOREIGN PATENT DOCUMENTS

| | | | |
|---|---|---|---|
| EP | 2184437 A2 | 5/2010 | |
| WO | WO 2013191687 A1 * | 12/2013 | E21B 33/1208 |

OTHER PUBLICATIONS

International Search Report and Written Opinion issued in International Application No. PCT/US2014/047623, dated Nov. 12, 2014 (11 pages).

(Continued)

*Primary Examiner* — Daniel P Stephenson
(74) *Attorney, Agent, or Firm* — Adolph Locklar

(57) ABSTRACT

A swellable packer which includes a generally tubular mandrel having a central axis and an exterior cylindrical surface. The swellable packer further includes a swellable elastomeric body fixed to the exterior cylindrical surface of the mandrel, wherein the swellable elastomeric body includes a plurality of grooves and wherein the generally tubular elastomeric sleeve has a circumference and a thickness.

19 Claims, 4 Drawing Sheets

(56) References Cited

U.S. PATENT DOCUMENTS

| | | | | |
|---|---|---|---|---|
| 8,225,861 | B2 | 7/2012 | Foster et al. | |
| 8,397,803 | B2 | 3/2013 | Crabb et al. | |
| 8,434,570 | B2 * | 5/2013 | Boulet | E21B 7/04 175/320 |
| 8,453,728 | B2 | 6/2013 | Heburn | |
| 8,555,961 | B2 * | 10/2013 | Koloy | E21B 33/1208 166/179 |
| 8,800,670 | B2 | 8/2014 | Lembcke et al. | |
| 2007/0158060 | A1 | 7/2007 | Baaijens et al. | |
| 2008/0093086 | A1 | 4/2008 | Courville et al. | |
| 2009/0200043 | A1 | 8/2009 | Olinger | |
| 2009/0211770 | A1 * | 8/2009 | Nutley | E21B 33/1208 166/387 |
| 2010/0051294 | A1 * | 3/2010 | Nutley | E21B 33/1208 166/387 |
| 2010/0147508 | A1 | 6/2010 | Foster | |
| 2010/0307737 | A1 * | 12/2010 | Mellemstrand | F16L 55/132 166/118 |
| 2011/0290472 | A1 | 12/2011 | Doweidt et al. | |
| 2012/0000676 | A1 | 1/2012 | Mebratu | |
| 2012/0012343 | A1 | 1/2012 | Wilkin et al. | |
| 2012/0018143 | A1 | 1/2012 | Lembcke | |
| 2012/0055667 | A1 * | 3/2012 | Ingram | E21B 33/1208 166/65.1 |
| 2012/0168160 | A1 | 7/2012 | Nutley et al. | |
| 2014/0318812 | A1 * | 10/2014 | Moyes | E21B 33/128 166/381 |
| 2015/0021044 | A1 * | 1/2015 | Davis | E21B 33/1208 166/378 |
| 2015/0021049 | A1 * | 1/2015 | Davis | E21B 33/1277 166/382 |
| 2016/0010422 | A1 * | 1/2016 | Goodman | E21B 33/128 166/378 |
| 2016/0024859 | A1 * | 1/2016 | Farmer | E21B 33/12 166/255.1 |
| 2016/0130907 | A1 * | 5/2016 | Lundgard | E21B 33/1208 166/387 |

OTHER PUBLICATIONS

Extended European Search Report issued in European U.S. Pat. No. 14829833.4, dated Feb. 16, 2017 (10 pages).

Definition of "groove" accessed Mar. 3, 2017 via www.thefreedictionary.com/groove.

Definition of "stepped" accessed Mar. 3, 2017 via www.thefreedictionary.com/stepped.

Definition of "coiled" accessed Mar. 3, 2017 via www.thefreedictionary.com/coiled.

Definition of "slipped" accessed Mar. 3, 2017 via www.thefreedictionary.com/slipped.

Office Action issued in EP Application No. 14829833.4, dated Feb. 22, 2018 (6 pages).

* cited by examiner

GROOVED SWELLABLE PACKER

CROSS-REFERENCE TO RELATED APPLICATIONS

This application is a non-provisional application which claims priority from U.S. provisional application No. 61/857,086, filed Jul. 22, 2013.

TECHNICAL FIELD/FIELD OF THE DISCLOSURE

The present disclosure relates to downhole packers for forming a well seal in an annulus between an inner tubular and either an outer tubular or a borehole wall, or forming a plug with the outer tubular or borehole wall.

BACKGROUND OF THE DISCLOSURE

Swellable packers are isolation devices used in a downhole wellbore to seal the inside of the wellbore or a downhole tubular that rely on elastomers to expand and form an annular seal when immersed in certain wellbore fluids. Typically, elastomers used in swellable packers are either oil- or water-sensitive. Various types of swellable packers have been devised, including packers that are fixed to the OD of a tubular and the elastomer formed by wrapped layers, and designs wherein the swellable packer is slipped over the tubular and locked in place.

SUMMARY

The present disclosure provides a swellable packer. The swellable packer includes a generally tubular mandrel having a central axis and an exterior cylindrical surface. The swellable packer further includes a swellable elastomeric body fixed to the exterior cylindrical surface of the mandrel, wherein the swellable elastomeric body comprises a plurality of grooves and wherein the generally tubular elastomeric sleeve has a circumference and a thickness.

The present disclosure further provides a method of isolating a section of wellbore. The method includes providing a swellable packer. The swellable packer includes a generally tubular mandrel having a central axis and an exterior cylindrical surface. The swellable packer further includes a swellable elastomeric body fixed to the exterior cylindrical surface of the mandrel, wherein the swellable elastomeric body comprises a plurality of grooves and wherein the generally tubular elastomeric sleeve has a circumference and a thickness. The method also includes inserting the swellable packer into the section of wellbore and exposing the swellable packer to a swelling fluid. The method further includes sealing the section of wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
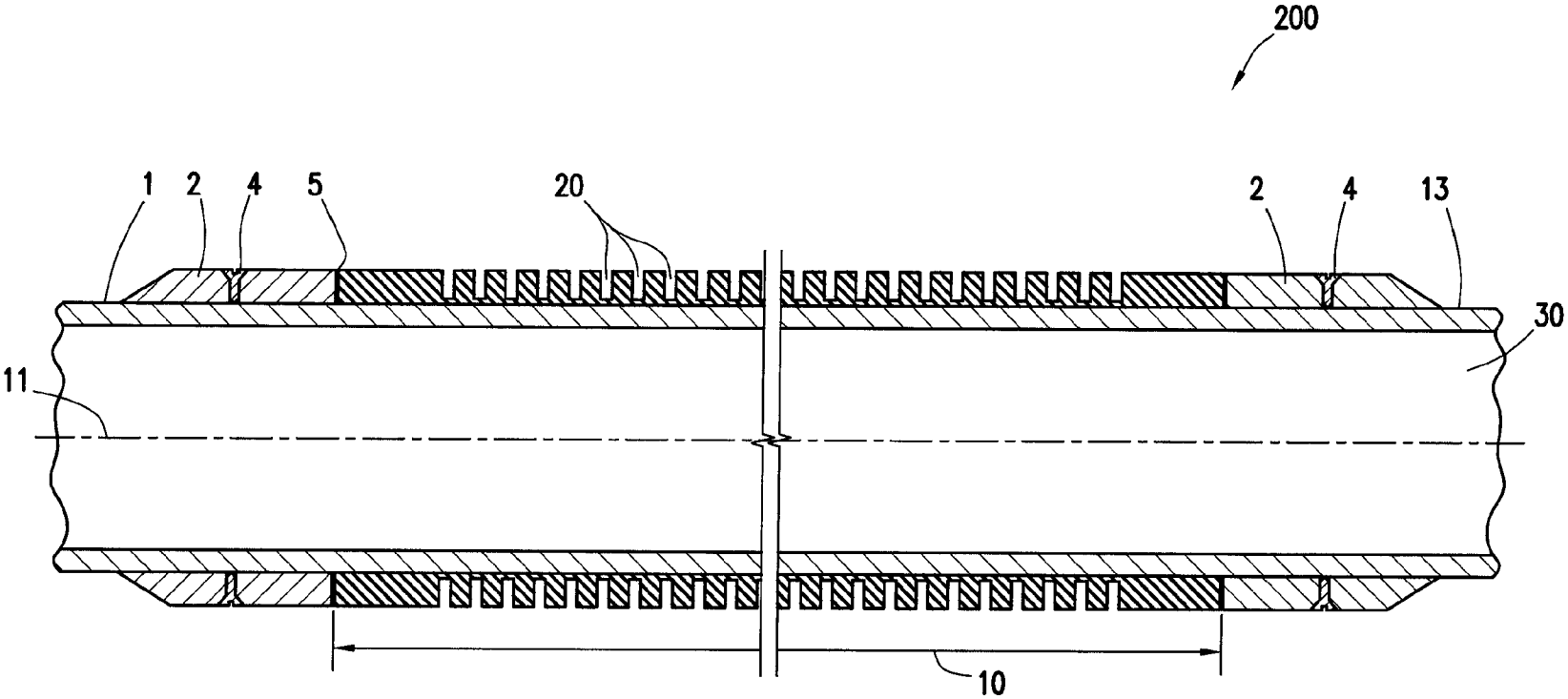
FIG. 1 is a sectional side view of a grooved swellable packer that is consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 illustrates one embodiment of grooved swellable packer 200 for positioning downhole in a well to seal with either the interior surface of a borehole or an interior surface of a downhole tubular. During operation, central axis 11 of grooved swellable packer 200 may be generally aligned with the central bore of the borehole or the central bore of the tubular in the well when grooved swellable packer 200 may be lowered to the desired depth in the well. Central axis 11 may also be generally aligned with the central bore of the borehole when grooved swellable packer 200 performs its sealing function.

In the embodiment depicted in FIG. 1, grooved swellable packer 200 may include mandrel 1 having a longitudinal axis aligned with central axis 11. Exterior surface 13 of mandrel 1 may be generally cylindrical. Mandrel 1 may be generally tubular, so that fluid may pass through bore 30 of packer 200. Swellable elastomeric body 10 may be positioned over the exterior surface of mandrel 1. In certain embodiments of the present disclosure, swellable elastomeric body 10 may be fixed to the outer diameter of mandrel 1 and formed by wrapped layers. In other embodiments, swellable elastomeric body 10 may be molded directly onto the outer diameter of mandrel 1. In other embodiments of the present disclosure, such as that depicted in FIG. 1, swellable elastomeric body 10 may be slipped over mandrel 1 and held in place at either end by endcap 2. Endcaps 2 may be held against mandrel 1 by any acceptable method, including, for example, adhesive, mechanical bonding, or as shown in FIG. 1 a set screw 4. In certain embodiments of the present disclosure, O-ring 5 may be inserted between endcaps 2 and swellable elastomeric body 10. In other embodiments of the present disclosure swellable elastomeric body 10 may be held in place with the use of a rigid end ring.

Figure 4:
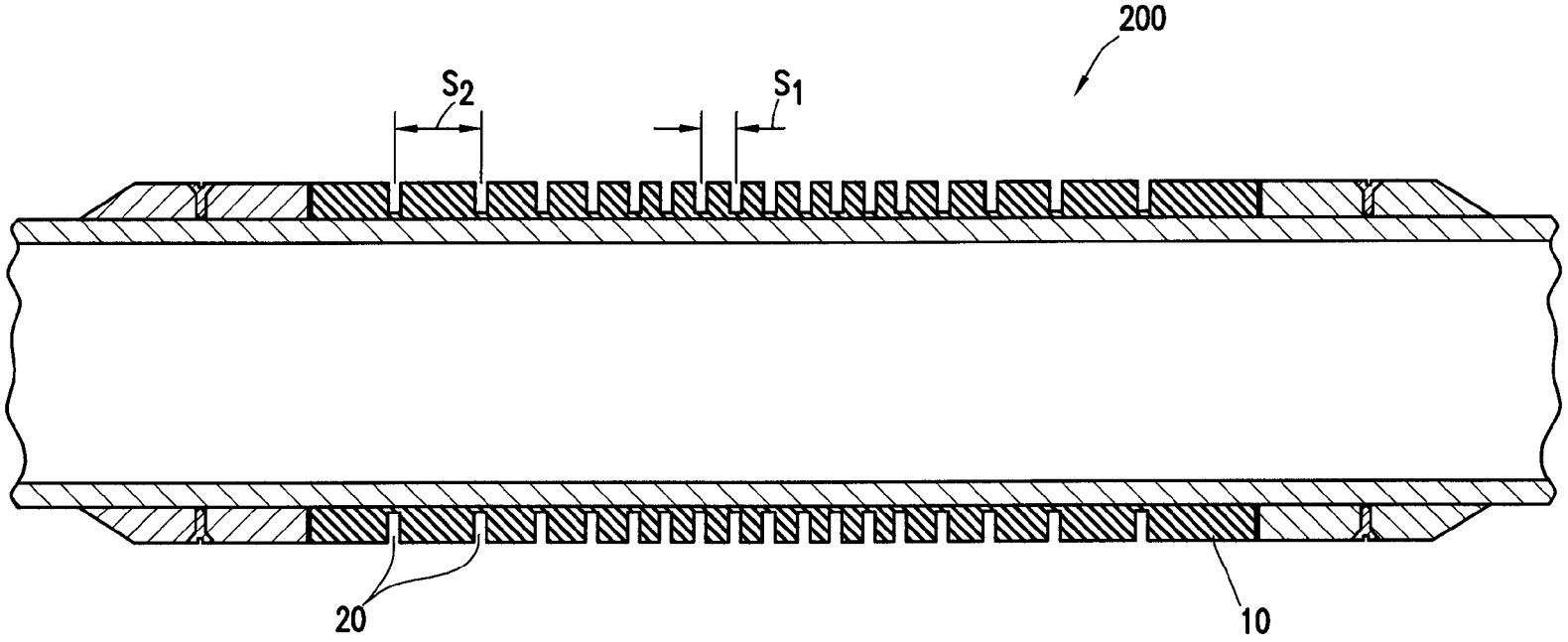
FIG. 4 is a cross section of a grooved swellable packer that is consistent with at least one embodiment of the present disclosure.

In some embodiments, Grooved swellable packer 200 may further include a plurality of grooves 20. Grooves 20 may be formed in the outer surface of swellable elastomeric body 10. In some embodiments, grooves 20 may be arranged circumferentially, longitudinally along central axis 11, or in a helical pattern. In some embodiments, grooves 20 may be equally spaced longitudinally (or radially for longitudinal grooves) or the space between adjacent grooves may vary. For example, as depicted in FIG. 4, grooves 20 towards the middle of swellable elastomeric body 10 may have a closer spacing (s1) than the spacing (s2) of grooves 20 toward the extremities of swellable elastomeric body 10 to, for example, further speed seal formation. One having ordinary skill in the art with the benefit of this disclosure will understand that grooves 20 may be formed in the outer surface of swellable elastomeric body 10 by any suitable process including, without limitation, injection molding, material removal (e.g. turning on a lathe, milling, melting, etc.), laminating, wrapping, compressing or other methods recognizable by those of ordinary skill in the art with the benefit of this disclosure. In some embodiments, grooved packer body 20 may be made up of two or more portions of swellable elastomer.

Figure 2:
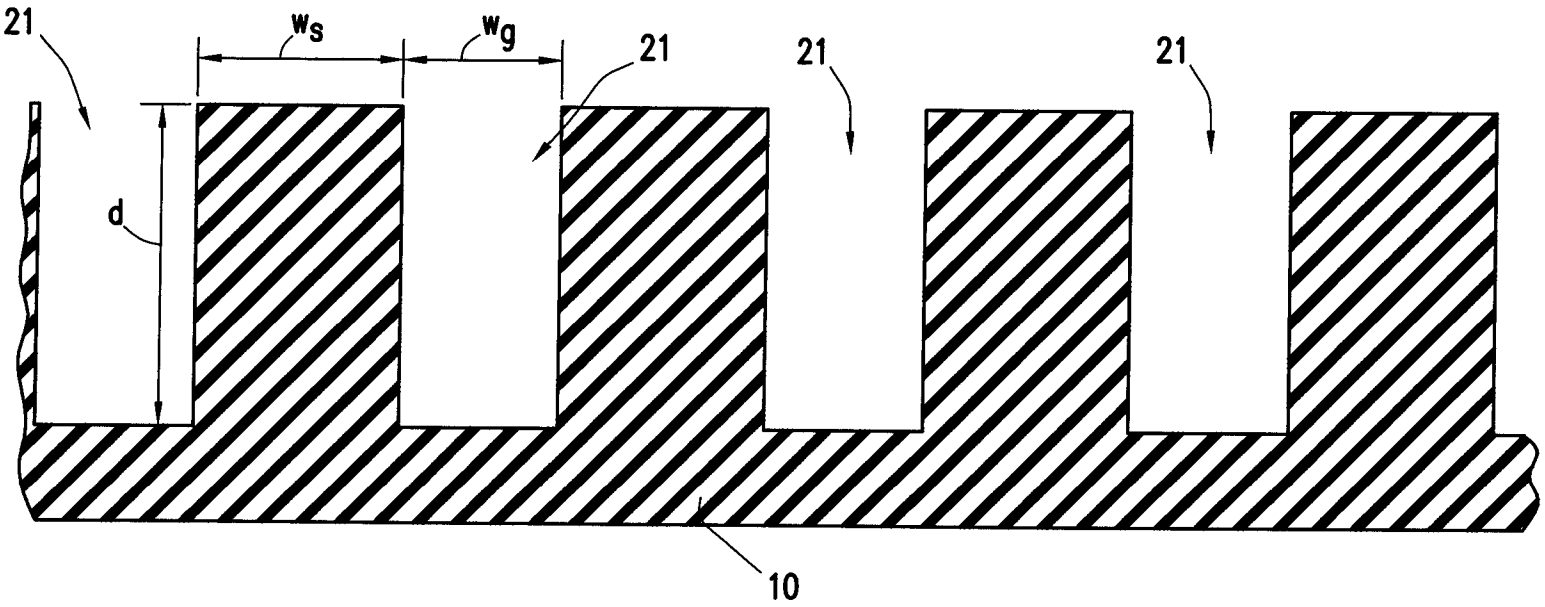
FIG. 2 is a partial cross-section of a swellable elastomeric body that is consistent with at least one embodiment of the present disclosure.
Figure 3:
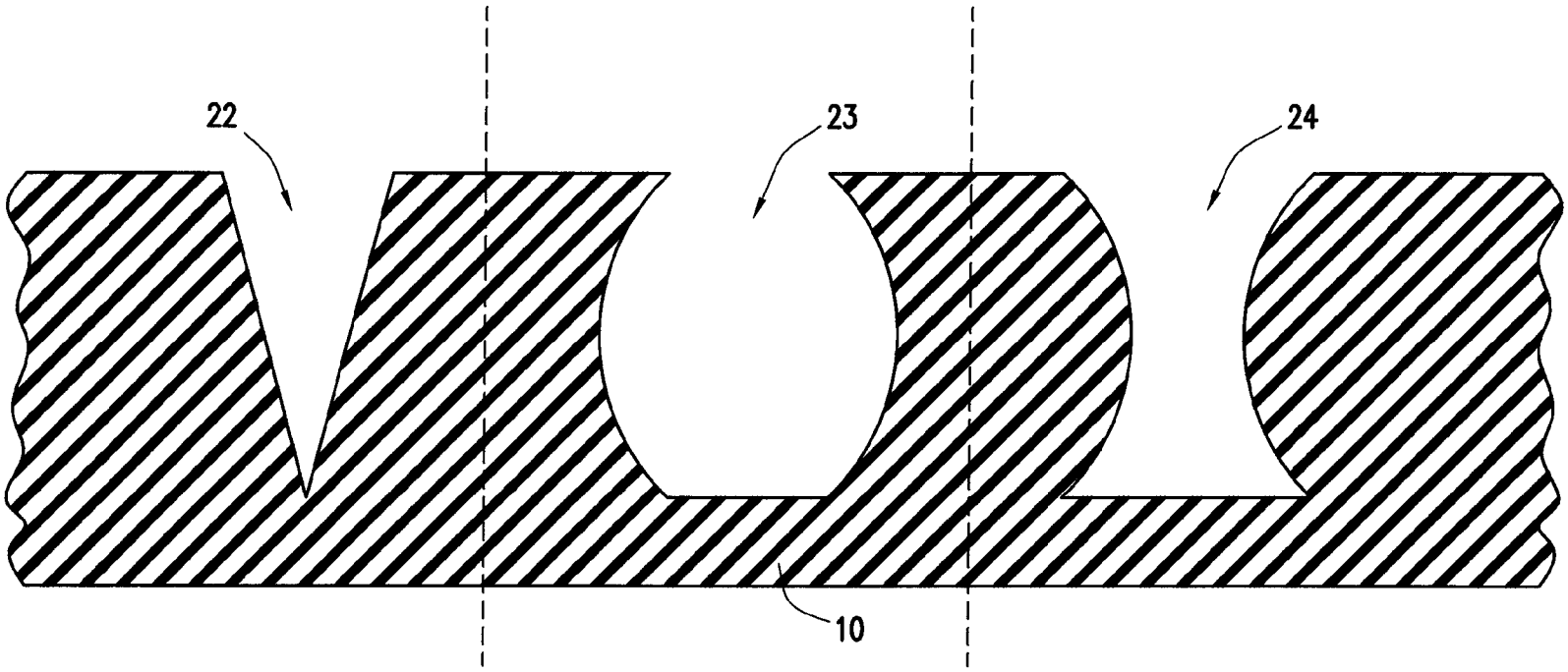
FIG. 3 is a partial cross-section of a swellable elastomeric body exhibiting grooves that are each consistent with at least one embodiment of the present disclosure.

Additionally, in some embodiments, grooves may be of varying cross-sectional geometry. For example, FIG. 2 shows a series of grooves 21 having rectangular cross sections. Each groove 21 has a depth d and a groove width $w_g$. Grooves may be spaced apart by spacing width $w_s$. Furthermore, as shown by FIG. 3, grooves 20 may have non-rectangular cross-sections. For example, in some embodiments, grooves 20 may be triangular 22, have concave walls 23, or have convex walls 24. One of ordinary skill in the art with the benefit of this disclosure will understand that specifications such as the number of grooves, depth d, groove width $w_g$, spacing width $w_s$, and cross-sectional shape may be varied to, for example, change the behavior of grooved swellable packer 200 depending on certain design parameters, including but not limited to material properties of swellable elastomeric body 10; length, diameter, and thickness of swellable elastomeric body 10; the rate at which grooved swellable packer 200 may be designed to seal; and the method used to form grooves 20. One of ordinary skill in the art will also understand that one or more of these specifications may be varied within the same swellable elastomeric body 10 such that grooves 20 in one section of swellable elastomeric body 10 may be different from those in a different section of swellable elastomeric body 10.

For example, the selection of groove width $w_g$ may directly impact the efficacy of the grooved swellable packer 200 in making a seal. Too wide of a groove width $w_g$ may result in inadequate sealing towards the middle of the groove. Rather than forming a relatively continuous seal between mandrel 1 and the wellbore or surrounding tubular, the base of the groove 20 may not fully contact the wellbore or surrounding tubular when fully swelled. Alternatively, too narrow of a groove width $w_g$ may not appreciably aid in sealing over a comparable swellable packer having no grooves. In some embodiments, the ratio between groove width $w_g$ and spacing width $w_s$ along with the number of grooves 20 per length of swellable elastomeric body 10 may be selected in light of these considerations.

In some embodiments, the number of grooves 20 may be from 5-500, from 25-100, or from 40-75. In some embodiments, Spacing widths $w_s$ between grooves 20 may be between 0.5 and 4 inches, alternatively between 0.75 and 2 inches, or alternatively about 1 inch. In some embodiments, the widths $w_g$ of grooves 20 may be between 0.05 inches to 1 inch, alternatively between 0.1 to 0.6 inches, or alternatively between about 0.15 to about 0.25 inches.

In some embodiments, Depths d of grooves 20 may depend in part on the thickness of swellable elastomeric body 10. As will be appreciated by those of ordinary skill in the art with the benefit of this disclosure, the rate at which grooved swellable packer 200 seals will depend in part on the depth d of grooves 20, but will also appreciate that the depth d of grooves 20 will also affect the integrity of swellable elastomeric body 10. In some embodiments, grooves 20 will not be so deep as to reach mandrel 1. In certain embodiments of the present disclosure, the groove penetrates between 1 and 95% of the thickness of swellable elastomeric body 10, between 1 and 50% of the thickness of swellable elastomeric body 10, or between 5 and 30% of the thickness of swellable elastomeric body 10.

In some embodiments, the distance between an endcap 2 and the first groove of grooves 20 may range from 1 inch to 1 foot, from 3 inches to 9 inches or between 4 and 7 inches.

In some embodiments, referring to FIG. 1, as grooved swellable packer 200 is inserted into the well, the outer diameter of grooved swellable packer 200 may be less than the surrounding wellbore or tubular member, allowing it to be positioned downhole. Swellable elastomeric body 10 may be formed from an elastomeric material which swells in response to the absorption of a swelling fluid, generally an oil or water-based fluid. The composition of the swelling fluid needed to activate grooved swellable packer 200 may be selected with consideration of the intended use of the packer. For example, a packer designed to pack off an area of a well at once may be either oil or water-based and activated by a fluid pumped downhole. Alternatively, a delayed-use packer may be positioned in a well for long periods of time during, for example, hydrocarbon production. A swellable elastomeric body 10 which swells in response to an oil-based fluid would prematurely pack off the annulus. A swellable elastomeric body 10 which swells in response to water would therefore be used. Furthermore, one having ordinary skill in the art would understand that this selection can allow grooved swellable packer 200 to automatically activate in response to environmental phenomena. Such a packer could be used, for example, to provide automatic zonal isolation in response to production of water in an actively producing well.

When grooved swellable packer 200 is activated, the selected swelling fluid comes into contact with swellable elastomeric body 10 and may be absorbed by the elastomeric material. In response to the absorption of swelling fluid, swellable elastomeric body 10 increases in volume and eventually contacts the wellbore, or the inner bore of the surrounding tubular. Grooves 20 may allow fluid to permeate further into swellable elastomeric body 10 than a comparable swellable body having no grooves. Deeper permeation of swelling fluid may allow swellable elastomeric body 10 to swell more quickly than a comparable swellable body having no grooves. Grooves 20 may also allow unabsorbed fluid to infiltrate or collect in locations around swellable elastomeric body 10 which would be otherwise inaccessible once swellable elastomeric body 10 begins to contact the wellbore or surrounding tubular.

Continued swelling of swellable elastomeric body 10 may form a fluid seal between mandrel 1 and the wellbore or surrounding tubular. Grooves 20 may allow a fluid seal to be established more rapidly and reliably. Pressure may be applied from one or more ends of packer 200.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method of isolating a section of wellbore comprising:
forming a swellable packer, wherein forming the swellable packer comprises:
providing a generally tubular mandrel having a central axis and an exterior cylindrical surface;
providing a swellable elastomeric body;
coupling the swellable elastomeric body to the exterior cylindrical surface of the mandrel; and
forming at least one groove in the outer surface of the swellable elastomeric body;
wherein the coupling and forming operations comprise:
wrapping layers of the swellable elastomeric body onto the mandrel; and
wrapping fewer layers of the swellable elastomeric body in a first location along the mandrel than at locations adjacent to the first location, thereby forming a groove
inserting the swellable packer into the section of wellbore;
exposing the swellable packer to a swelling fluid; and
sealing the section of wellbore.

2. The method of claim 1, wherein the swelling fluid is water based.

3. The method of claim 1, wherein the swelling fluid is oil based.

4. The method of claim 1 further comprising:
flowing the swelling fluid into the groove.

5. The method of claim 1, wherein the exposing of the swellable packer to a swelling fluid occurs in response to environmental conditions.

6. A method of forming a swellable packer comprising:
providing a generally tubular mandrel having a central axis and an exterior cylindrical surface;
providing a swellable elastomeric body;
coupling the swellable elastomeric body to the exterior cylindrical surface of the mandrel; and
forming at least one groove in the outer surface of the swellable elastomeric body;
wherein the coupling and forming operations comprise:
wrapping layers of the swellable elastomeric body onto the mandrel; and
wrapping fewer layers of the swellable elastomeric body in a first location along the mandrel than at locations adjacent to the first location, thereby forming a groove.

7. The method of claim 6, wherein the forming operation comprises:
turning the swellable elastomeric body on a lathe, and
removing material to form a groove in the swellable elastomeric body.

8. The method of claim 6, wherein the coupling and forming operations comprise:
molding the swellable elastomeric body to the exterior cylindrical surface of the mandrel; and
molding a groove in the swellable elastomeric body.

9. The method of claim 6, wherein the forming operation comprises:
selectively compressing the swellable elastomeric body in at least one location, causing a groove to be formed.

10. The method of claim 6, wherein the groove is arranged in a helical pattern about the swellable elastomeric body.

11. The method of claim 6, wherein the groove is arranged circumferentially about the swellable elastomeric body.

12. The method of claim 6, further comprising wrapping fewer layers of the swellable elastomeric body at a second location along the mandrel than at locations adjacent the second location, thereby forming a second groove.

13. The method of claim 12, wherein the distance between the grooves is between 0.5 and 4 inches.

14. The method of claim 6, wherein the width of the groove is between 0.05 inches and 1 inch.

15. The method of claim 6, wherein the depth of the groove is between 1% and 50% of the thickness of the swellable elastomeric body.

16. The method of claim 6, wherein the groove has a rectangular cross-section.

17. The method of claim 6, wherein the groove has a triangular cross-section.

18. The method of claim 6, wherein the groove further comprises side-walls having a curved profile.

19. The method of claim 6, wherein the swellable elastomeric body is adapted to swell in response to contact with a swelling fluid, the swelling fluid selected from a group consisting of water based and oil based fluids.

* * * * *